US011067930B2

(12) United States Patent
Sato

(10) Patent No.: US 11,067,930 B2
(45) Date of Patent: Jul. 20, 2021

(54) IMAGE FORMING APPARATUS INCLUDING FIRST AND SECOND SENSORS READING DIFFERENT SURFACES AT DIFFERENT POSITIONS TO DETECT POSTURE AND SHAPE OF A SHEET

(71) Applicant: CANON KABUSHIKI KAISHA, Tokyo (JP)

(72) Inventor: Kengo Sato, Koshigaya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/809,029

(22) Filed: Mar. 4, 2020

(65) Prior Publication Data

US 2020/0292977 A1 Sep. 17, 2020

(30) Foreign Application Priority Data

Mar. 11, 2019 (JP) ..... JP2019-043792

(51) Int. Cl.
*G03G 15/00* (2006.01)

(52) U.S. Cl.
CPC ..... *G03G 15/5029* (2013.01); *G03G 15/5062* (2013.01)

(58) Field of Classification Search
CPC ..... G03G 15/5029; G03G 15/5062
See application file for complete search history.

(56) References Cited

U.S. PATENT DOCUMENTS 9,848,098 B2 12/2017 Mita
2016/0337529 A1* 11/2016 Kubota ..... H04N 1/0057

* cited by examiner

*Primary Examiner* — Joseph S Wong
(74) *Attorney, Agent, or Firm* — Rossi, Kimms & McDowell LLP

(57) ABSTRACT

An image forming apparatus includes an image forming unit configured to form an image on a sheet; a second reading sensor, and a controller. The first reading sensor is provided on a conveyance path, and is configured to read a first surface of the sheet conveyed along the conveyance path. The second reading sensor is provided at a position different from a position of the first reading sensor, and is configured to read a second surface which is on a side opposite to the first surface of the sheet conveyed along the conveyance path. The controller is configured to control the image forming unit to form measurement images for measurement of printing positions on the sheet, control the first reading sensor to read end portions of the sheet, and to control the second reading sensor to read the end portions of the sheet.

13 Claims, 11 Drawing Sheets

IMAGE FORMING APPARATUS INCLUDING FIRST AND SECOND SENSORS READING DIFFERENT SURFACES AT DIFFERENT POSITIONS TO DETECT POSTURE AND SHAPE OF A SHEET

BACKGROUND OF THE INVENTION

Field of the Invention

The present disclosure relates to an image forming apparatus such as a printer, and more particularly, to a technology of correcting a position of an image to be formed on a sheet.

Description of the Related Art

In a production printing market, on-demand printers come into wide use in place of offset printers having hitherto been used. Examples of the on-demand printers include an electrophotographic image forming apparatus using powder toner and an inkjet image forming apparatus using ink. With regard to the image forming apparatus configured to perform on-demand printing, there is a demand for achievement of an image quality equivalent to that of the offset printer and improvement in productivity. The improvement in productivity is not limited to improvement in printing speed of the image forming apparatus, and there is a demand for improvement in overall speed of a workflow from reception of a manuscript to submission of the manuscript in the printing market. With regard to an image forming apparatus like the on-demand printer targeting small-lot and short-time production, there is a task of improvement in productivity other than output time. For example, there are tasks of reducing correction times of color correction for each sheet type and printing position correction for both surfaces of a sheet.

In related-art, an image forming apparatus, at the time of performing the printing position correction for both surfaces of a sheet, for example, measurement images for use in measurement of printing positions are printed on a sheet. A user actually measures positions of the measurement images from the sheet through use of a scale, calculates deviation amounts of printing positions, and inputs the calculated deviation amounts to the image forming apparatus. The image forming apparatus performs printing with correction of the printing positions in accordance with the input deviation amounts. Alternatively, a user uses a personal computer to correct the printing positions in accordance with the deviation amounts, and allows the image forming apparatus to perform printing. Further, an image forming apparatus including an image reading apparatus such as a scanner acquires deviation amounts of printing positions based on results of reading measurement images with the image reading apparatus, and automatically performs correction of the printing positions. In a case of correcting the printing positions, detection accuracy for the deviation amounts and correction accuracy for the printing positions are very important.

In U.S. Pat. No. 9,848,098 B2, there is disclosed an image forming apparatus configured to automatically correct printing positions on both surfaces of a sheet. This image forming apparatus forms measurement images on both surfaces of a sheet and reads the measurement images on both surfaces of the sheet through use of a scanner. The image forming apparatus acquires deviation amounts of printing positions from results of reading the measurement images, and performs an image forming process with correction of the printing positions based on the deviation amounts. The image forming apparatus detects shapes of a front surface and a back surface of the sheet from the results of reading, and calculates correction values for matching lengths of corresponding sides based on those shapes. The image forming apparatus acquires positions of the measurement images corrected with the above-mentioned correction values from the results of reading, and calculates the deviation amounts.

In the related-art, an image forming apparatus is capable of suppressing a difference in conveyance speed of a sheet between the time of reading the front surface and the time of reading the back surface or an error in deviation amount of the printing positions caused by a difference in performance between a reading unit for the front surface and a reading unit for the back surface. However, in a case in which the sheet having the measurement images formed thereon is skews or turns, the measurement images are not accurately read, with the result that the correction accuracy for the printing positions is degraded. In particular, in the case of detecting the shapes of the front surface and the back surface of the sheet from the results of reading, there is difficulty in suppressing the error in deviation amount of the printing positions. Further, also in a case in which the sheet is not rectangular due to problems relating to, for example, cutting accuracy for the sheet, there is difficulty in accurate correction of the printing positions. Therefore, in order to perform the correction of the printing positions with higher accuracy, it is required to perform correction of a rotation error and a perpendicularity error of an image in addition to magnification correction. The present disclosure has been made in view of the problems described above, and has a main object to provide an image forming apparatus which is capable of correcting printing positions with high accuracy through improvement in detection accuracy for positions of measurement images.

SUMMARY OF THE INVENTION

An image forming apparatus according to the present disclosure includes an image forming unit configured to form an image on a sheet; a first reading sensor, which is provided on a conveyance path, and is configured to read a first surface of the sheet conveyed along the conveyance path; a second reading sensor, which is provided at a position different from a position of the first reading sensor in a conveyance direction of the sheet, and is configured to read a second surface different from the first surface of the sheet conveyed along the conveyance path; and a controller, which is configured to control the image forming unit to form measurement images on the sheet, control the first reading sensor to read end portions of the sheet in the conveyance direction and the measurement images on the sheet, control the second reading sensor to read the end portions of the sheet in the conveyance direction, and to control a printing position of the image to be formed on the first surface of the sheet based on a reading result of the first reading sensor and a reading result of the second reading sensor.

Further features of the present invention will become apparent from the following description of exemplary embodiments (with reference to the attached drawings).

DESCRIPTION OF THE EMBODIMENTS

Now, at least one embodiment of the present disclosure is described in detail with reference to the drawings.

Configuration

Figure 1:
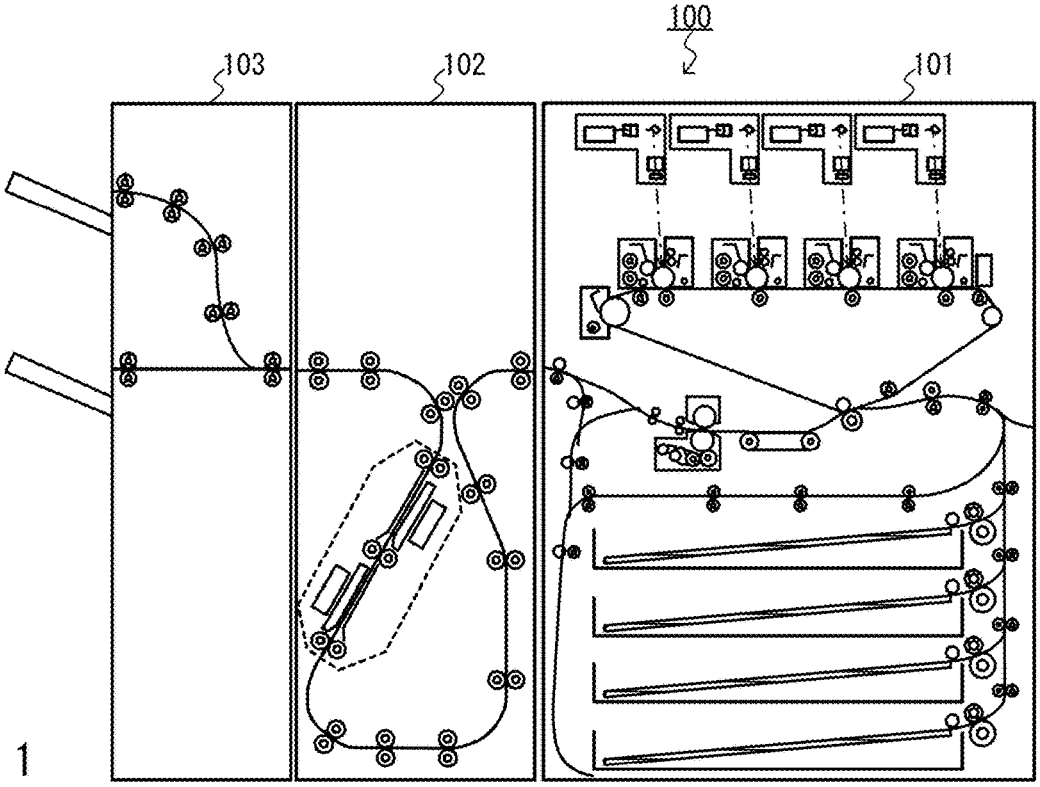
FIG. 1 is a configuration view for illustrating an image forming system.

FIG. 1 is a configuration view for illustrating an image forming system in this embodiment. An image forming system 100 includes an image forming apparatus 101, an image reading apparatus 102, and a post-processing apparatus 103. The image forming apparatus 101 is configured to form an image on a sheet and feed the sheet to the image reading apparatus 102. The image reading apparatus 102 is configured to read the image formed on the sheet. In this embodiment, the image forming apparatus 101 forms measurement images for measurement of printing positions on the sheet. The image reading apparatus 102 reads the measurement images formed on the sheet. The image forming apparatus 101 forms an image which has been corrected in printing positions based on results of reading the measurement images. The post-processing apparatus 103 is configured to perform predetermined post-processing on the sheet having the image formed thereon and corrected in printing positions and deliver the sheet.

Image Forming Apparatus

Figure 2:
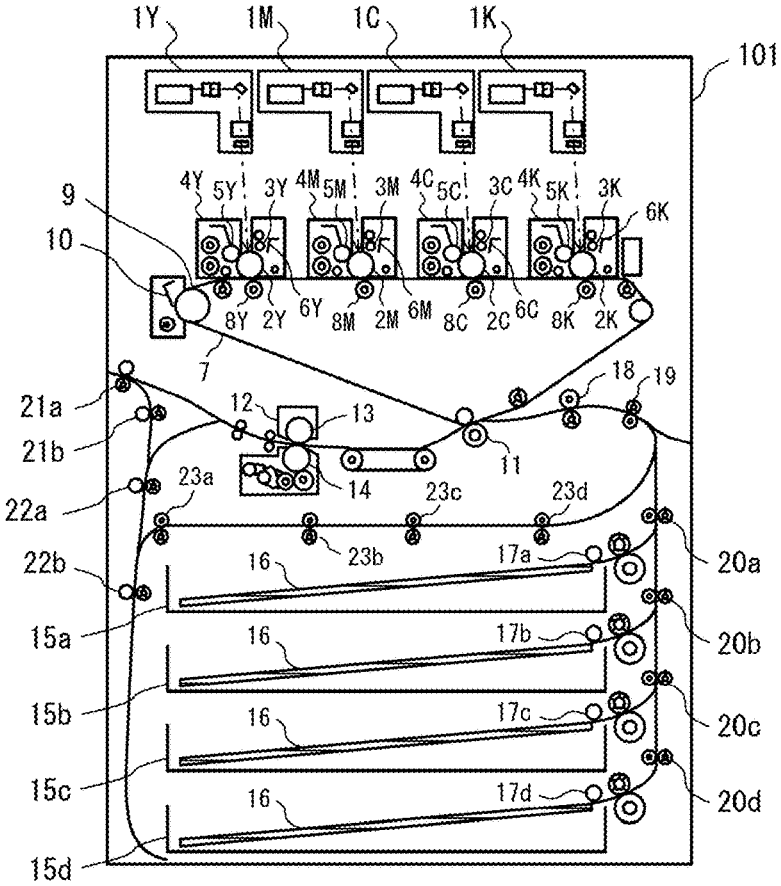
FIG. 2 is a configuration view for illustrating an image forming apparatus.

FIG. 2 is a configuration view for illustrating the image forming apparatus 101. The image forming apparatus 101 is capable of forming a color image. The image forming apparatus 101 has a configuration for forming an image on a sheet and a configuration for feeding sheets.

With the configuration for forming an image on a sheet, color images of yellow (Y), magenta (M), cyan (C), and black (K) are formed. For such operation, the image forming apparatus 101 includes laser scanners 1Y, 1M, 1C, and 1K, photosensitive drums 2Y, 2M, 2C, and 2K, charging rollers 3Y, 3M, 3C, and 3K, developing devices 4Y, 4M, 4C, and 4K, and cleaners 6Y, 6M, 6C, and 6K. Images of corresponding colors are formed on the photosensitive drums 2Y, 2M, 2C, and 2K, respectively. The image forming apparatus 101 includes an intermediate transfer belt 7 to which the color images are transferred. For the transfer to the intermediate transfer belt 7, primary transfer rollers 8Y, 8M, 8C, and 8K are provided so as to correspond to the photosensitive drums 2Y, 2M, 2C, and 2K. Further, the image forming apparatus 101 includes a secondary transfer roller 11 configured to transfer the images from the intermediate transfer belt 7 onto the sheet, a cleaner 10 for the intermediate transfer belt 7, and a fixing device 12 configured to fix the images on the sheet. The characters Y, M, C, and K added to the ends of the reference symbols represent colors of images to be formed. In the following description, in a case where there is no need to distinguish the colors, the characters Y, M, C, and K added to the ends of the reference symbols are omitted.

With the configuration for feeding sheets, sheets 16 accommodated in sheet-feeding cassettes 15*a*, 15*b*, 15*c*, and 15*d* are fed to a conveyance path. An image is formed on the sheet 16 by the configuration for forming an image while the sheet 16 is conveyed on the conveyance path. The sheet-feeding cassettes 15*a*, 15*b*, 15*c*, and 15*d* include sheet-feeding rollers 17*a*, 17*b*, 17*c*, and 17*d*, respectively, to feed the sheets 16 one by one to the conveyance path. On the conveyance path, there are provided conveyance roller pairs 20*a*, 20*b*, 20*c*, and 20*d*, a preregistration roller pair 19, a registration roller pair 18, and delivery roller pairs 21*a* and 21*b* in the stated order from an upstream side in a conveyance direction of the sheets 16. The secondary transfer roller 11 and the fixing device 12 are provided between the registration roller pair 18 and the delivery roller pair 21*a*. The conveyance path includes a reverse path for conveying a sheet from the fixing device 12 to the preregistration roller pair 19 at the time of duplex printing. On the reverse path, there are provided reverse roller pairs 22*a* and 22*b* and double-sided conveyance roller pairs 23*a*, 23*b*, 23*c*, and 23*d*.

Details of each part are described.

The photosensitive drum 2 is a photosensitive member formed of an aluminum cylinder and an organic photoconductive layer applied to an outer periphery of the aluminum cylinder. The photosensitive drum 2 is driven by a drive motor (not shown) to rotate in a counterclockwise direction in FIG. 2. The charging roller 3 is configured to uniformly charge the surface of the photosensitive drum 2 to which the organic photoconductive layer is applied. The laser scanner 1 is configured to scan the charged surface of the photosensitive drum 2 with a laser beam modified based on image data of a corresponding color. An electrostatic latent image is formed on the photosensitive drum 2 through the scanning with the laser beam. The developing device 4 includes a developing sleeve 5. The developing device 4 uses the developing sleeve 5 to develop the electrostatic latent image on the photosensitive drum 2 with toner of a corresponding color. An image (toner image) of the corresponding color is formed on the photosensitive drum 2 through the developing. The formed image (toner image) is conveyed toward the primary transfer roller 8 by rotation of the photosensitive drum 2.

The intermediate transfer belt 7 is held in contact with the photosensitive drums 2Y, 2M, 2C, and 2K, and is driven by an intermediate transfer drive roller 9 to rotate in a clockwise direction in FIG. 2. Color images (toner images) on the photosensitive drums 2Y, 2M, 2C, and 2K are sequentially transferred onto the intermediate transfer belt 7 so as to be superimposed on one another. A full-color image (toner image) is formed on the intermediate transfer belt 7 through the transfer of the color images (toner images) in superimposition. At the time of the transfer, the primary transfer roller 8 urges the intermediate transfer belt 7 toward the photosensitive drum 2 side. The image (toner image) having been transferred is conveyed toward the secondary transfer roller 11 by rotation of the intermediate transfer belt 7. Toner which remains on the photosensitive drum 2 after the transfer is removed by a cleaner 6. The toner having been removed is collected into a cleaner container (not shown).

The intermediate transfer belt 7 conveys the sheet 16, with the sheet 16 being between the transfer belt 7 and the secondary transfer roller 11, to transfer the image (toner image) onto the sheet 16. The secondary transfer roller 11 is urged toward the intermediate transfer belt 7 side during the transfer of the image (toner image) from the intermediate transfer belt 7 to the sheet 16. However, after completion of the printing processing, the secondary transfer roller 11 separates from the intermediate transfer belt 7. Toner which remains on the intermediate transfer belt 7 after the transfer is removed by the cleaner 10. The toner having been removed is collected into a cleaner container (not shown).

The fixing device 12 includes a fixing roller 13 and a pressure roller 14. The fixing device 12 is configured to perform fixing processing with the fixing roller 13 and the pressure roller 14 while conveying the sheet 16. The fixing roller 13 has a hollow shape with a heater provided therein, and is configured to heat the sheet 16. The pressure roller 14 is configured to bring the sheet 16 into pressure-contact with the fixing roller 13.

The sheets 16 on which an image is to be formed in the manner described above are fed one by one from any one of the sheet-feeding cassettes 15*a*, 15*b*, 15*c*, and 15*d* by corresponding one of the sheet-feeding rollers 17*a*, 17*b*, 17*c*, and 17*d*. The sheet 16 having been fed is conveyed by corresponding one of the conveyance roller pairs 20*a*, 20*b*, 20*c*, and 20*d* and the preregistration roller pair 19 to the registration roller pair 18. The registration roller pair 18 conveys the sheet 16 to the secondary transfer roller 11 in synchronization with scanning by the laser scanners 1Y, 1M, 1C, and 1K with respective laser beams. An image is transferred from the intermediate transfer belt 7 to the sheet 16 by the secondary transfer roller 11 as described above. After that, the image is fixed on the sheet 16 by the fixing device 12, and the sheet 16 is delivered to an outside of the image forming apparatus.

In a case where the sheet 16 is to be directly delivered (straight delivery), the sheet 16 is delivered from the fixing device 12 through the delivery roller pair 21*a*. In a case where the sheet 16 is to be delivered in a reversed state (reverse delivery), the sheet 16 is conveyed from the fixing device 12 to the reverse roller pair 22*a* on the reverse path. The reverse roller pair 22*a* is rotatable in forward and reverse directions, and reversely rotates the sheet 16 after obtaining the sheet 16 from the fixing device 12. With this operation, the sheet 16 is delivered by the reverse roller pair 22*a* from the reverse path to the outside of the image forming apparatus through the delivery roller pairs 21*a* and 21*b*. The straight delivery and the reverse delivery are performed in accordance with the setting by a print job. Switching of the conveyance paths is performed by, for example, a flapper (not shown).

In the case of the duplex printing, the sheet 16 is conveyed from the fixing device 12 to the reverse roller pairs 22*a* and 22*b* on the reverse path. The reverse roller pair 22*b* is also forwardly and reversely rotatable similarly to the reverse roller pair 22*a*. At the time of the duplex printing, the sheet 16 is conveyed to the reverse roller pair 22*b*, and is thereafter conveyed to the double-sided conveyance roller pairs 23*a*, 23*b*, 23*c*, and 23*d* by the reverse rotation of the reverse roller pair 22*b*. With this operation, one surface of the sheet 16 on which the image has been formed is reversed, and an image can be formed on another surface of the sheet 16. The double-sided conveyance roller pairs 23*a*, 23*b*, 23*c*, and 23*d* convey the sheet 16 to the preregistration roller pair 19 and the registration roller pair 18 again. An image is formed on the another surface of the sheet 16 similarly to the image forming on the one surface. The sheet 16 is delivered to the outside of the image forming apparatus after completion of the duplex printing.

Image Reading Apparatus

Figure 3:
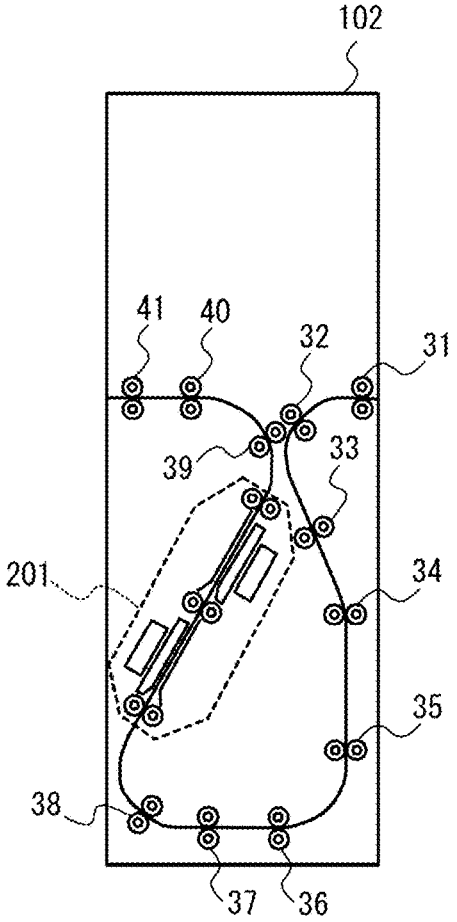
FIG. 3 is a configuration view for illustrating an image reading apparatus.

FIG. 3 is a configuration view for illustrating the image reading apparatus 102. The image reading apparatus 102 obtains the sheet 16 delivered from the image forming apparatus 101. The image reading apparatus 102 is configured to read an image formed on the sheet 16 while conveying the sheet 16. For such operation, the image reading apparatus 102 includes, on a conveyance path thereof, conveyance roller pairs 31 to 41 and an image reading unit 201. The image reading unit 201 is capable of reading images from both surfaces of the sheet 16 conveyed by the conveyance roller pairs 31 to 41 on the conveyance path. The image reading apparatus 102 feeds the sheet 16 having been subjected to the image reading to the post-processing apparatus 103. The image reading apparatus 102 in this embodiment reads measurement images formed on the sheet 16. In accordance with a result of reading the sheet 16, end portions of the sheet 16 and printing positions of the measurement images are detected. Correction values for the printing positions are derived from results of those detections.

Figure 4:
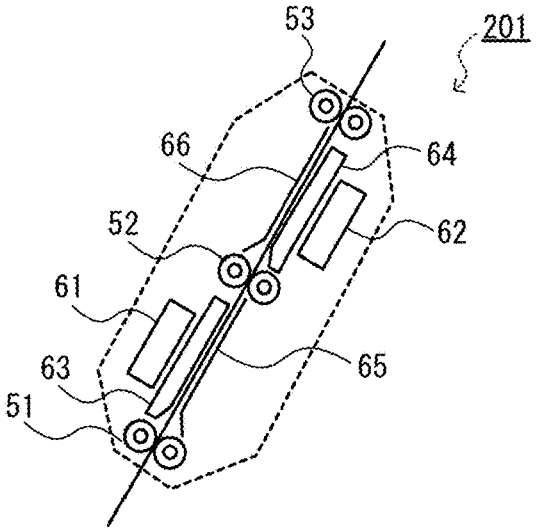
FIG. 4 is an explanatory configuration view for illustrating an image reading unit.
Figure 5:
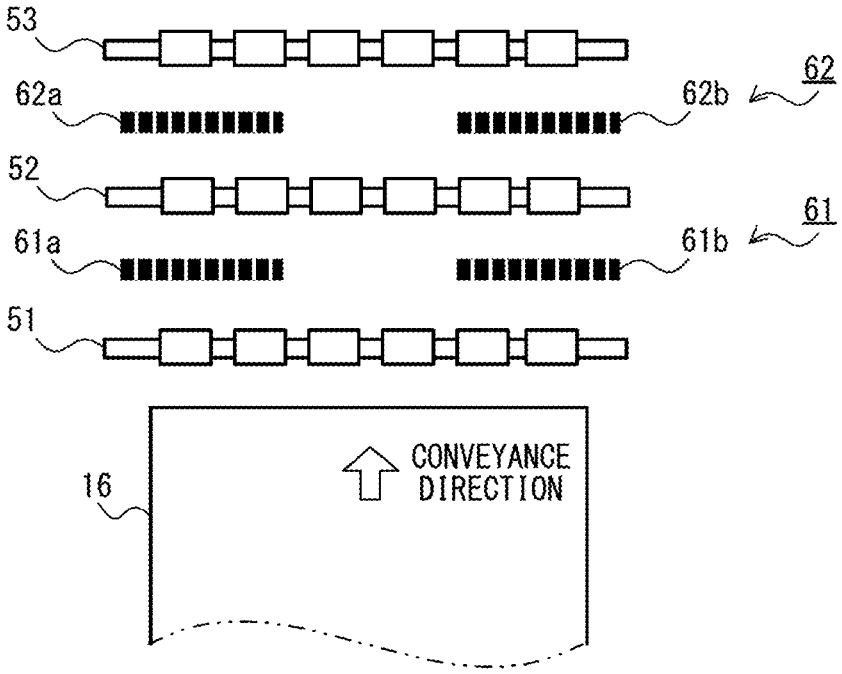
FIG. 5 is an explanatory configuration view for illustrating the image reading unit.
Figure 6:
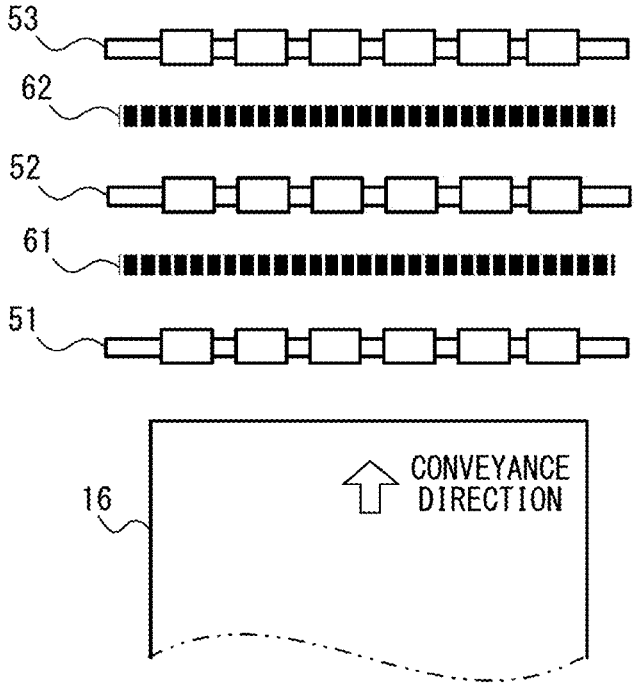
FIG. 6 is an explanatory configuration view for illustrating the image reading unit.

FIG. 4, FIG. 5, and FIG. 6 are explanatory configuration views for illustrating the image reading unit 201. The image reading unit 201 includes contact image sensors (CISs) 61 and 62 on both sides across the conveyance path to read both surfaces of the sheet 16 as the sheet 16 passes through the conveyance path only one time. On the upstream side of the CIS 61 in the conveyance direction of the sheet 16, there is provided a conveyance roller pair 51 configured to convey the sheet 16 to a reading position of the CIS 61. Between the CIS 61 and the CIS 62 in the conveyance direction of the sheet 16, there is provided a conveyance roller pair 52 configured to convey the sheet 16 from the reading position of the CIS 61 to a reading position of the CIS 62. On the downstream side of the CIS 62 in the conveyance direction of the sheet 16, there is provided a conveyance roller pair 53 configured to convey the sheet 16 from the reading position of the CIS 62 to an outside of the image reading unit 201. At the reading position of the CIS 61, there are provided conveyance guide members 63 and 65 on both sides across the conveyance path. At the reading position of the CIS 62, there are provided conveyance guide members 64 and 66 on both sides across the conveyance path.

The sheet 16 is conveyed by the conveyance roller pair 51 to a position between the conveyance guide member 63 and the conveyance guide member 65, and the CIS 61 performs image reading processing for one surface (first surface). After that, the sheet 16 is conveyed by the conveyance roller pair 52 to a position between the conveyance guide member 64 and the conveyance guide member 66, and the CIS 62 performs image reading processing for another surface (second surface) which is on a side opposite to the first surface. The image reading unit 201 performs the image reading while conveying the sheet 16 through use of the conveyance roller pairs 51 to 53, thereby shortening the time taken for correction of the printing positions.

The CIS 61 and the CIS 62 are arranged close to each other while being opposed to each other, and hence the measurement images printed on both surfaces of the sheet 16 are read substantially at the same time. Thus, influence of, for example, a temperature, a moisture amount, and a conveyance speed of the sheet 16 on the correction accuracy for the printing positions is suppressed. The conveyance guide members 63 and 64 are glass members serving also to stabilize positions of the CIS 61 and the CIS 62 in a focal depth direction. The conveyance guide members 65 and 66 are black backing members serving also to clarify contrast at end portions of the sheet 16.

The CISs 61 and 62 in FIG. 5 each have the following configuration to be able to read the end portions of the sheet 16. Specifically, the CIS 61 includes a CIS 61*a* and a CIS 61*b* arranged in a direction orthogonal to the conveyance direction, and the CIS 62 includes a CIS 62*a* and a CIS 62*b* arranged in the direction orthogonal to the conveyance direction. Thus, reading regions of the CIS 61 and the CIS 62 are each divided into two. The CIS 61 and the CIS 62 in FIG. 6 are each configured to read the sheet 16 in the direction orthogonal to the conveyance direction of the sheet 16 one line at a time. In any of those cases, the CIS 61 and the CIS 62 are capable of reading both end portions of the sheet 16 in the direction orthogonal to the conveyance direction. The image reading unit 201 in this embodiment reads the sheet 16 through use of the CIS 61 and the CIS 62. However, the configuration for reading the sheet 16 is not limited to such configuration, and may be achieved with a device such as a CCD sensor capable of performing image reading.

Printing Position Correction

Figure 7:
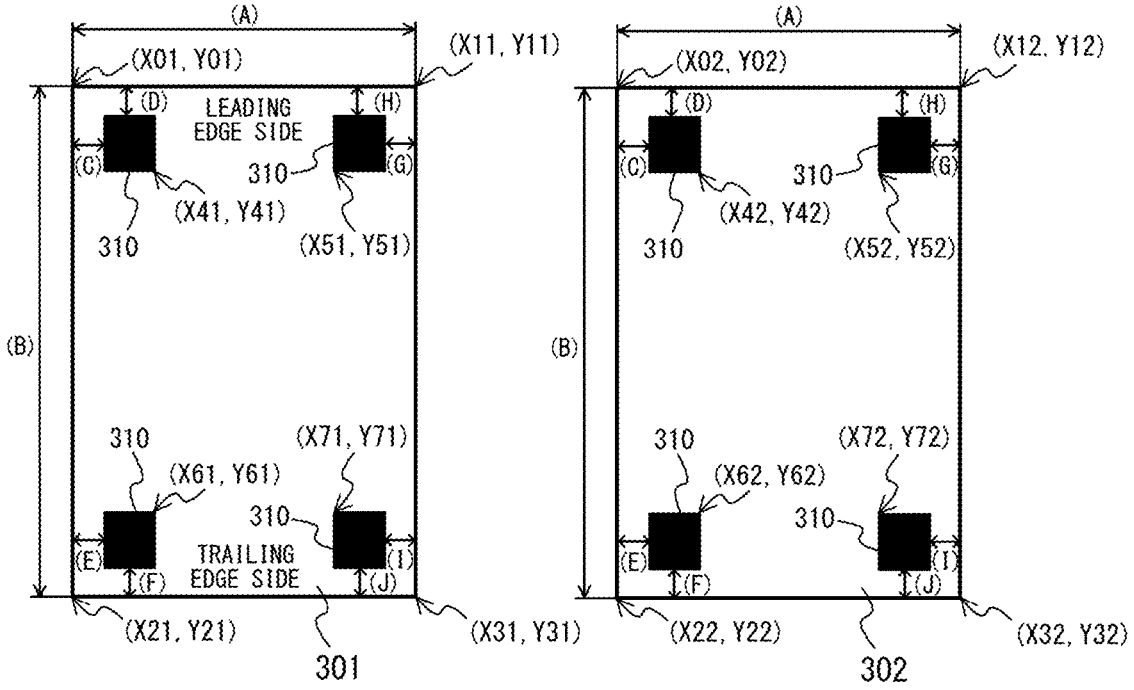
FIG. 7 is an explanatory view for illustrating measurement images.

FIG. 7 is an explanatory view for illustrating measurement images for measurement of printing positions. The measurement images include reference images 310 formed near four corners of each of a first surface 301 and a second surface 302 of the sheet 16. From results of reading the measurement images with the image reading apparatus 102, coordinates of end portions of the first surface 301 and the second surface 302 of the sheet 16, and coordinates of printing positions of the reference images 310 are obtained. The coordinates of the printing positions are calculated based on distances A to J.

Coordinates of the end portions of the first surface 301 . . . (X01, Y01) to (X31, Y31)

Coordinates of the end portions of the second surface 302 . . . (X02, Y02) to (X32, Y32)

Coordinates of the printing positions of the reference images 310 on the first surface 301 . . . (X41, Y41) to (X71, Y71)

Coordinates of the printing positions of the reference images 310 on the second surface 302 . . . (X42, Y42) to (X72, Y72)

Based on those coordinates, distortion amounts of an image and deviation amounts of the printing positions are measured. Based on the measured deviation amounts, correction values to be used for correction of the deviation of the printing positions are derived. The image forming apparatus 101 performs the image forming based on the correction values, thereby being capable of producing the sheet 16 (product) on which printing positions of the images on both surfaces are corrected.

Figure 8A:
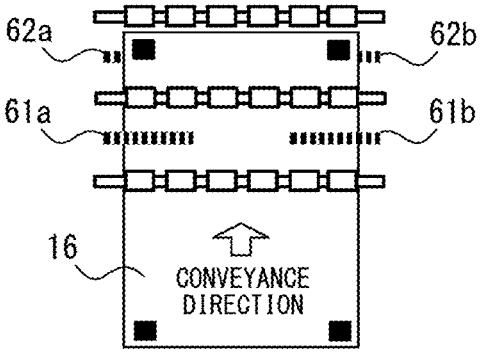
FIG. 8A, FIG. 8B, FIG. 8C, FIG. 8D, and FIG. 8E are explanatory views for illustrating posture states of a sheet.

FIG. 8A to FIG. 8E are explanatory views for illustrating posture states of the sheet 16 at the time of reading the sheet 16. FIG. 8A is an illustration of a state in which a side of the sheet 16 at a leading edge of the sheet 16 in the conveyance direction substantially matches with a direction orthogonal to the conveyance direction so that the sheet 16 is conveyed straight in the conveyance direction. In this case, the coordinates of the end portions of the first surface 301 and the second surface 302 of the sheet 16, and the coordinates of the printing positions of the reference images 310 are accurately measured. However, in a case where the side of the sheet 16 at the leading edge of the sheet 16 does not match with the direction orthogonal to the conveyance direction, or in a case where the sheet 16 is not conveyed straight in the conveyance direction, there is difficulty in accurately measuring the coordinates of the end portions of the first surface 301 and the second surface 302, and the coordinates of the printing positions of the reference images 310. Further, also in a case where the CISs 61 and 62 are not accurately arranged in the direction orthogonal to the conveyance direction, there is difficulty in accurately measuring the coordinates of the end portions of the first surface 301 and the second surface 302, and the coordinates of the printing positions of the reference images 310. FIG. 8B to FIG. 8E are illustrations of posture states of the sheet 16 in the cases in which the measurement is difficult.

Figure 8B:
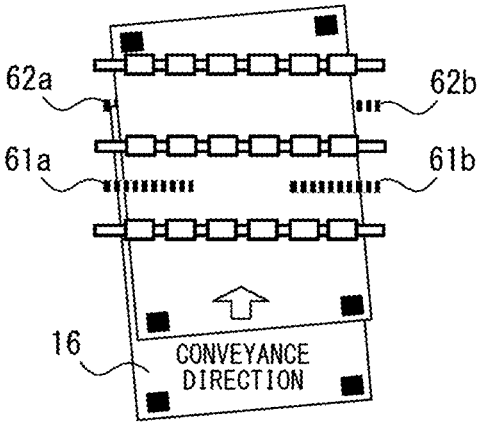
Figure 8C:
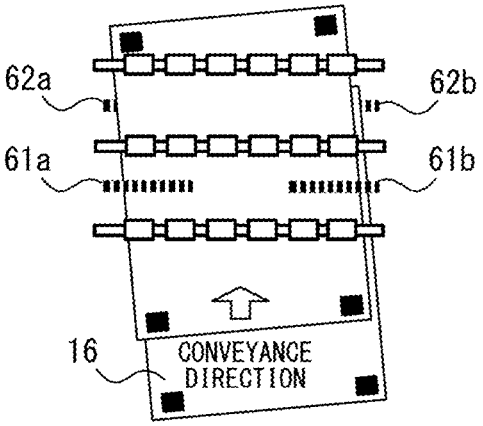
Figure 8D:
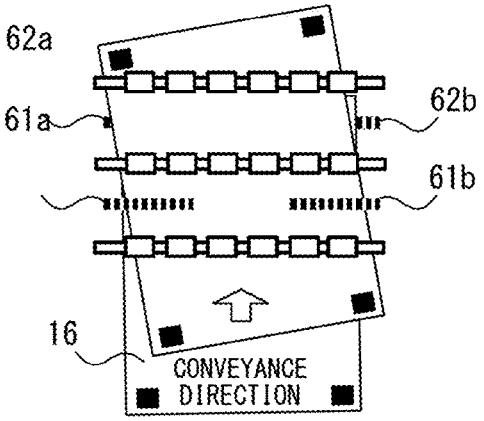
Figure 8E:
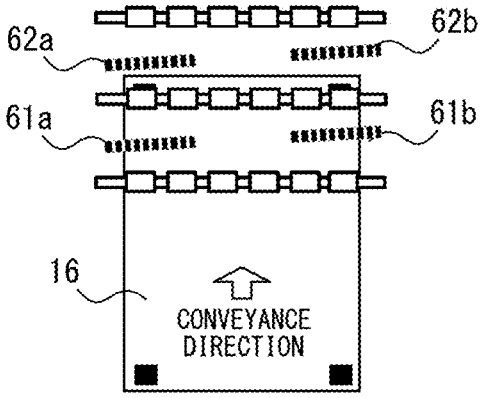

FIG. 8B is an illustration of a state in which the sheet 16 is conveyed in an inclined state (skew feed). FIG. 8C is an illustration of a state in which the sheet 16 is conveyed in an oblique direction (oblique conveyance). FIG. 8D is an illustration of a state in which the sheet 16 is conveyed while turning. FIG. 8E is an illustration of a state in which the CISs 61 and 62 are misaligned with respect to the conveyance roller pairs 51 and 52, with the result that the CISs 61 and 62 are not accurately arranged in the direction orthogonal to the conveyance direction.

The image forming apparatus 101 according to this embodiment detects the skew feed of the sheet 16, the oblique conveyance of the sheet 16, the turning of the sheet 16, cutting deviation of the sheet 16, and misalignment of the CISs 61 and 62 from results of reading the measurement images with the CIS 61 and the CIS 62 arranged opposed to each other, and gives feedback to the correction of the printing positions. With this, the correction of the printing positions is performed with high accuracy.

FIG. 9A to FIG. 14C are explanatory views for illustrating the printing position correction. FIG. 9A to FIG. 14C are illustrations of a state in which the sheet 16 is read while being conveyed inside the image reading unit 201. The sheet 16 is read during a period from arrival of the leading edge thereof at the reading position of the CIS 61 to passage of a trailing edge thereof in the conveyance direction through the reading position of the CIS 62.

Figure 9A:
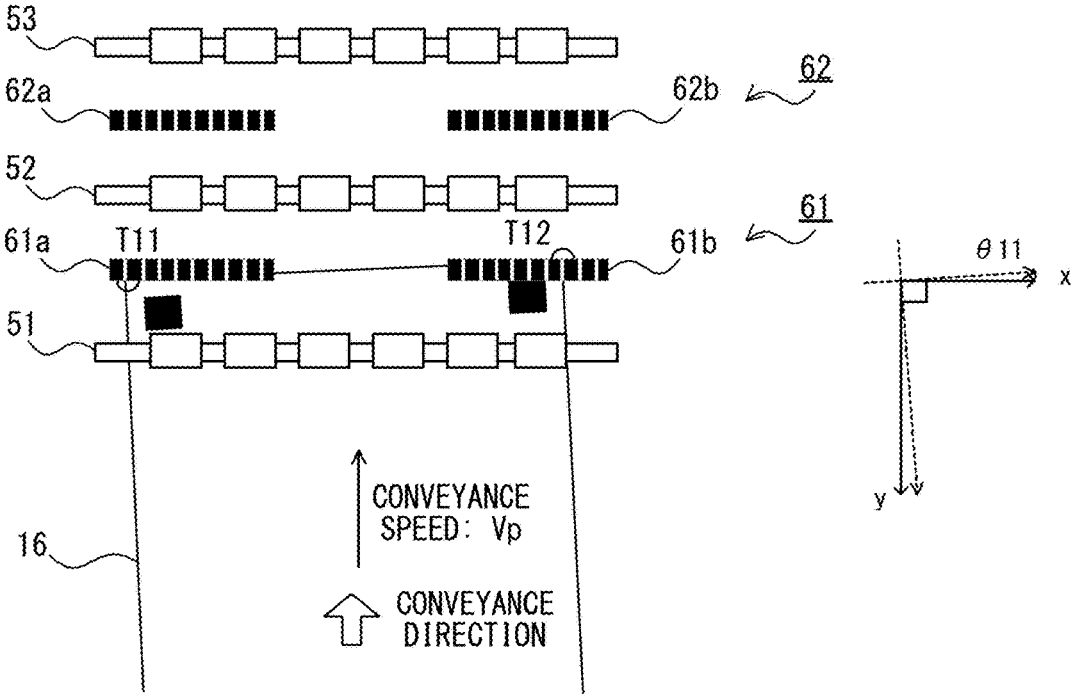
FIG. 9A and FIG. 9B are explanatory views for illustrating printing position correction.
Figure 9B:
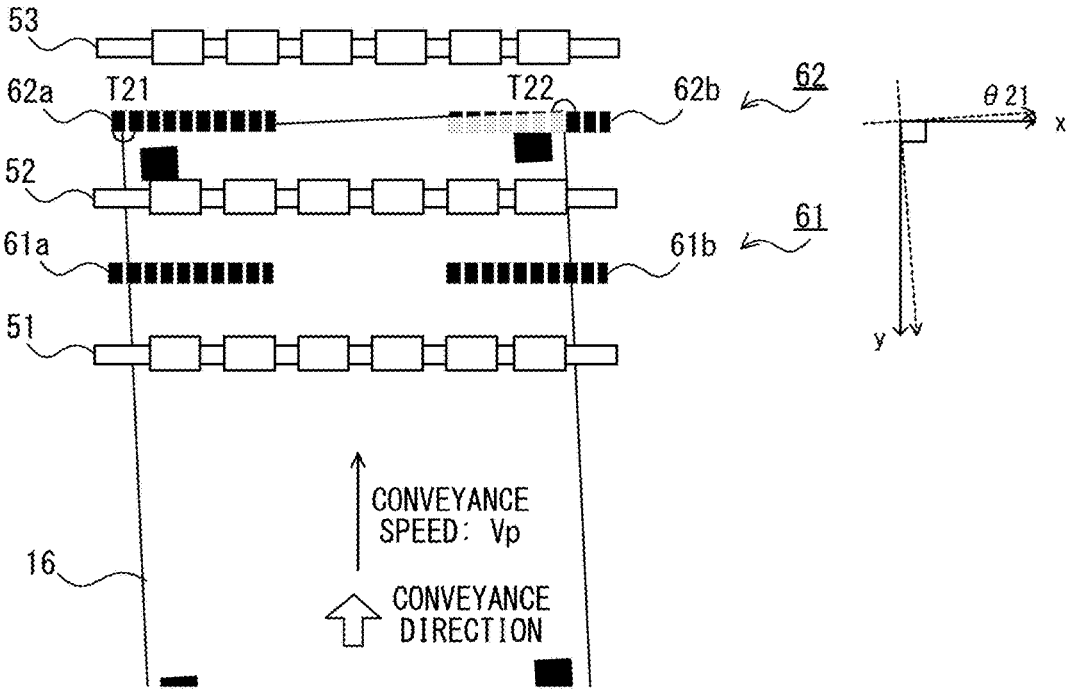

FIG. 9A and FIG. 9B are illustrations of a posture state given when the sheet 16 is conveyed to the reading positions of the CISs 61 and 62 while the leading edge of the sheet 16 is inclined. In FIG. 9A, the leading edge of the sheet 16 has arrived at reading positions of the CISs 61*a* and 61*b*. In FIG. 9B, the leading edge of the sheet 16 has arrived at reading positions of the CISs 62*a* and 62*b*.

Based on timings T11 and T12 at which the leading edge of the sheet 16 arrives at the reading positions of the CISs 61*a* and 61*b*, a leading-edge angle θ11 of the side of the sheet 16 at the leading edge of the sheet 16 with respect to the direction orthogonal to the conveyance direction is detected. For example, the leading-edge angle θ11 is expressed by the following expression.

$$\theta 11=\arcsin((T11-T12)\times Vp/A)\times 180/\pi \text{ deg}$$

In the expression, "(T11−T12)" represents a difference between a timing at which the CIS 61*a* has detected the leading edge of the sheet 16, and a timing at which the CIS 61*b* has detected the leading edge of the sheet 16, "Vp" represents a conveyance speed given when the leading edge of the sheet 16 is read with the CISs 61*a* and 61*b*, and "A" represents a length of the side of the sheet 16 at the leading edge of the sheet 16.

Similarly, based on timings T21 and T22 at which the leading edge of the sheet 16 arrives at the reading positions of the CISs 62*a* and 62*b*, a leading-edge angle θ21 of the side of the sheet 16 at the leading edge of the sheet 16 with respect to the direction orthogonal to the conveyance direction is detected. For example, the leading-edge angle θ21 is expressed by the following expression.

$$\theta 21=\arcsin((T21-T22)\times Vp/A)\times 180/\pi \text{ deg}$$

In the expression, "(T21−T22)" represents a difference between a timing at which the CIS 62*a* has detected the leading edge of the sheet 16, and a timing at which the CIS 62*b* has detected the leading edge of the sheet 16.

Figure 10:
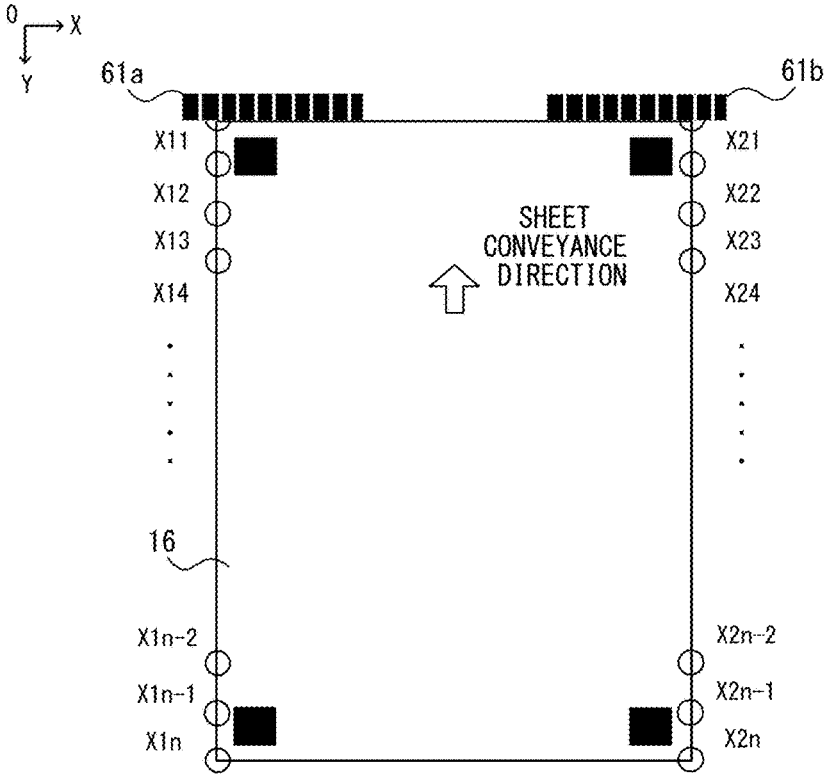
FIG. 10 is an explanatory view for illustrating the printing position correction.
Figure 11:
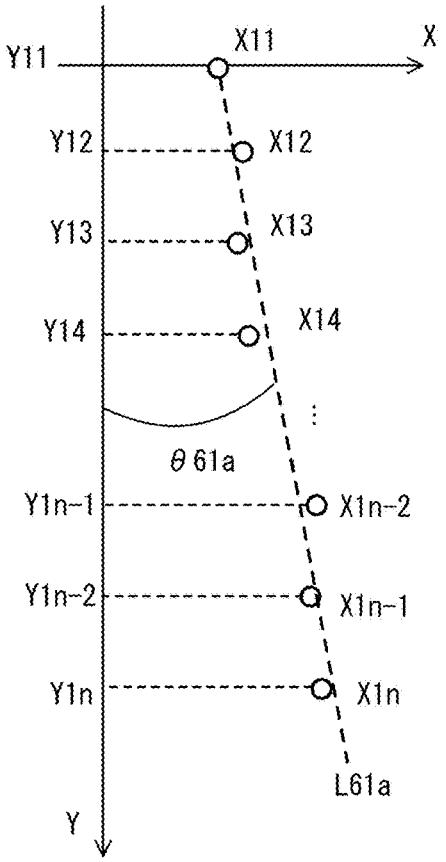
FIG. 11 is an explanatory view for illustrating the printing position correction.

FIG. 10 and FIG. 11 are explanatory views for illustrating detection processing for a posture state of the sheet 16. From results of detection of sides on both end portions of the sheet 16 in the direction orthogonal to the conveyance direction (both right and left end portions) with the CISs 61 and 62, an inclination of the sheet 16 with respect to the conveyance direction is detected. The CIS 61 and the CIS 62 are similarly used for detection of the right and left end portions of the sheet 16. In FIG. 10, a case of using the CISs 61*a* and 61*b* is described, and a description of a case of using the CISs 62*a* and 62*b* is omitted.

Through reading of the left end portion of the sheet 16 with the CIS 61*a* during conveyance, left end portions X11, X12, X13, X14, . . . X1*n*−2, X1*n*−1, and X1*n* of the sheet 16 are detected. A straight line L61*a* is obtained based on the left end portions X11 X12, X13, X14, . . . X1*n*−2, X1*n*−1, and X1*n* (FIG. 11). Similarly, through reading of the right end portion of the sheet 16 with the CIS 61*b* during conveyance, right end portions X21, X22, X23, X24, . . . X2*n*−2, X2*n*−1, and X2*n* of the sheet 16 are detected.

Lengths from the leading edge of the sheet 16 to the left end portions in the conveyance direction are represented by Y11, Y12, . . . Y1*n*−2, Y1*n*−1, and Y1*n*, and lengths to the right end portions are represented by Y21, Y22, . . . Y2*n*−2, Y2*n*−1, and Y2*n*. Based on the results of reading the both end portions with the CIS 61*a*, the CIS 61*b*, the CIS 62*a*, and the CIS 62*b*, and on the lengths Y11, Y12, . . . of the left end portions, and the lengths Y21, Y22, . . . of the right end portions, respective average values Xave and Yave are determined. For example, an average value X1ave of the left end portions and an average value Y1ave of the lengths of the left end portions which are detected through use of the CIS 61*a* are expressed as follows.

$$X1\text{ave}=(X11+X12+\ldots+X1n-11+X1n)/n$$

$$Y1\text{ave}=(Y11+Y12+\ldots+Y1n-1+Y1n)/n$$

Based on those average values X1ave and Y1ave, an inclination angle θ61*a* of the left end portion of the sheet 16 with respect to the conveyance direction, which is measured based on the results of reading with the CIS 61*a*, is obtained by the following expression through use of, for example, a least square method.

$$\theta 61a=\arctan((\Sigma Xi\cdot Yi-n\cdot X1\text{ave}\cdot Y1\text{ave})/(\Sigma Yi\hat{}2-n\cdot X1\text{ave}\hat{}2))\times 180/\pi-\theta 11 \text{ deg}$$

Similarly, an inclination angle θ62*a* of the left end portion of the sheet 16 with respect to the conveyance direction, which is measured based on the results of reading with the CIS 62*a*, is obtained. An inclination angle θ61*b* of the right end portion of the sheet 16 with respect to the conveyance direction, which is measured based on the results of reading with the CIS 61*b*, is obtained. An inclination angle θ62*b* of the right end portion of the sheet 16 with respect to the conveyance direction, which is measured based on the results of reading with the CIS 62*b*, is obtained.

In FIG. 12A to FIG. 12D, a relationship between the inclination angles θ61*a*, θ61*b*, θ62*a*, and θ62*b* of the right and left end portions of the sheet 16 and a posture state of the sheet 16 is illustrated. Straight lines L61*a* and L62*a* of the left end portion and straight lines L61*b* and L62*b* of the right end portion are obtained from the results of reading with the CISs 61*a*, 61*b*, 62*a*, and 62*b*.

Figure 12A:
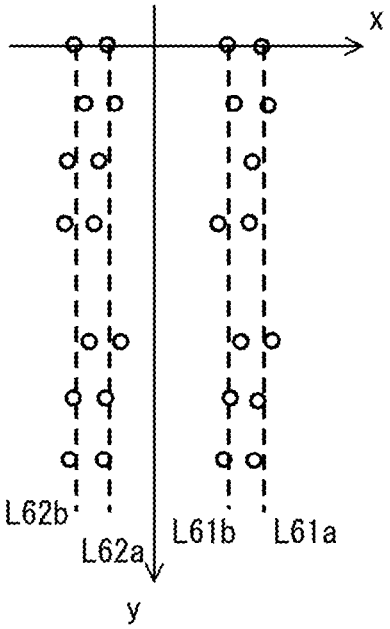
FIG. 12A, FIG. 12B, FIG. 12C, and FIG. 12D are explanatory views for illustrating the printing position correction.

FIG. 12A is an illustration of a case in which the sheet 16 is read while being conveyed straight or being in a state of skew feed. In a case where the sheet 16 is conveyed straight, the leading-edge angles θ11 and θ21 of the sheet 16 are equal to each other and are each 0 deg. Further, the inclination angles θ61*a*, θ61*b*, θ62*a*, and θ62*b* are all 0 deg. When the sheet 16 skews, the leading-edge angles θ11 and θ21 of the sheet 16 are equal to each other, and are both not 0 deg. Further, the inclination angles θ61*a*, θ61*b*, θ62*a*, and θ62*b* are equal.

Figure 12B:
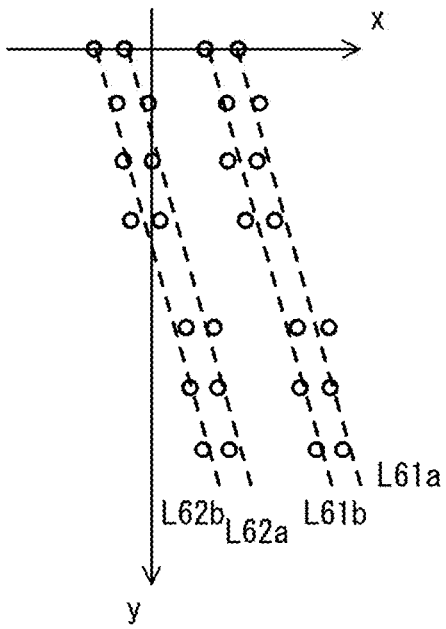

FIG. 12B is an illustration of a case in which the sheet 16 is read while being in a state of oblique conveyance. In this case, the inclination angle θ61*a* and the inclination angle θ62*a* are equal to each other, and are both not 0 deg. Further, the inclination angle θ61*b* and the inclination angle θ62*b* are equal to each other, and are both not 0 deg.

Figure 12C:
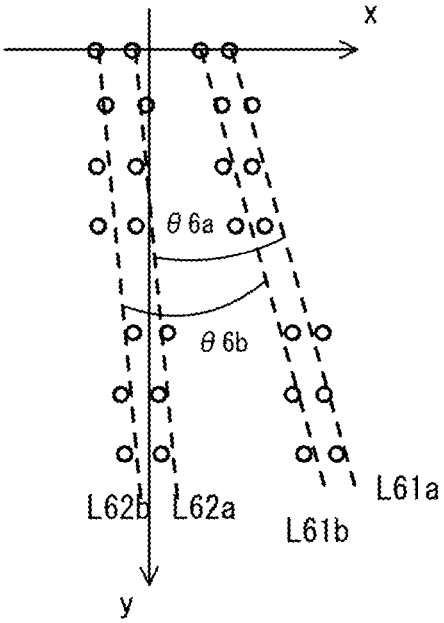

FIG. 12C is an illustration of a case in which the sheet 16 is read while turning. In this case, the inclination angle θ61*a* and the inclination angle θ62*a* are not equal to each other. Further, the inclination angle θ61*b* and the inclination angle θ62*b* are not equal to each other. Still further, a difference θ6*a* between the inclination angle θ61*a* and the inclination angle θ62*a*, and a difference θ6*b* between the inclination angle θ61*b* and the inclination angle θ62*b* are equal to each other.

Figure 12D:
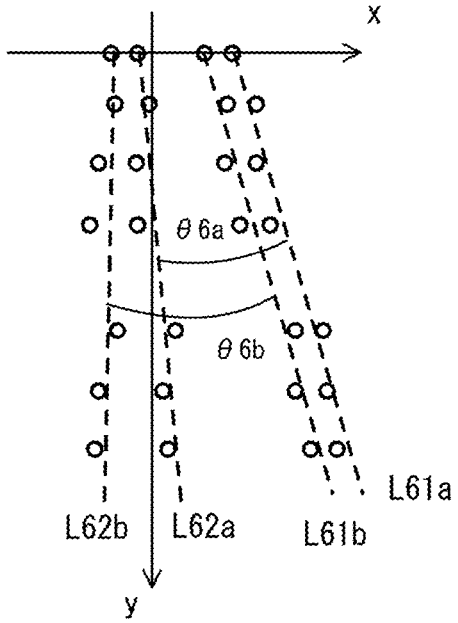

FIG. 12D is an illustration of a case in which the sheet 16 is changed in shape due to the cutting deviation and an apex forming the right angle deviates. In this case, the inclination angle θ61*a* and the inclination angle θ62*a* are not equal to each other. Further, the inclination angle θ61*b* and the inclination angle θ62*b* are not equal to each other. Still further, the difference θ6*a* between the inclination angle θ61*a* and the inclination angle θ62*a*, and the difference θ6*b* between the inclination angle θ61*b* and the inclination angle θ62*b* are not equal to each other.

Figure 13A:
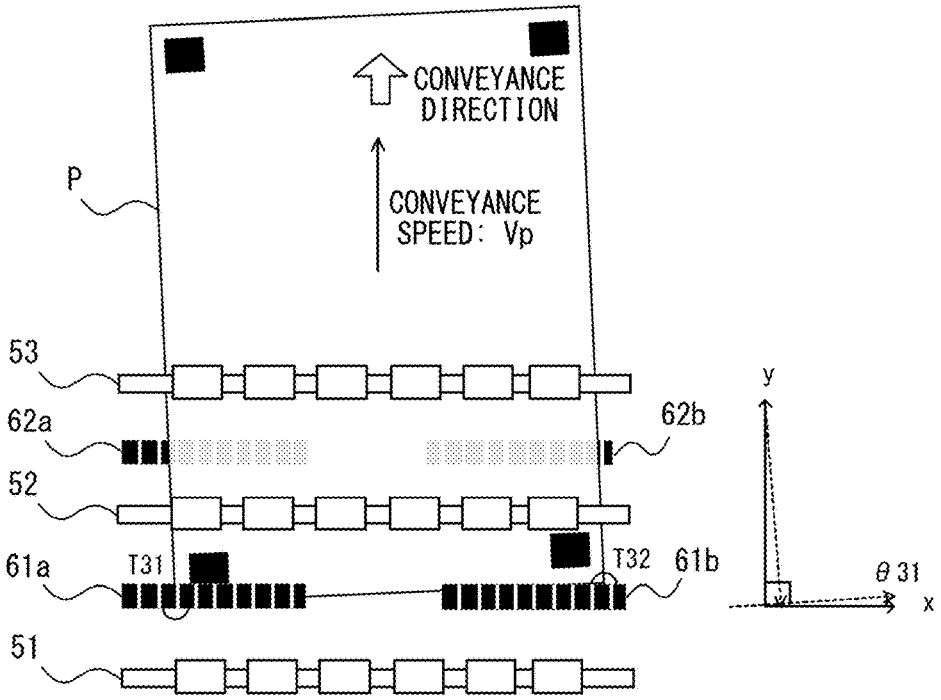
FIG. 13A and FIG. 13B are explanatory views for illustrating the printing position correction.
Figure 13B:
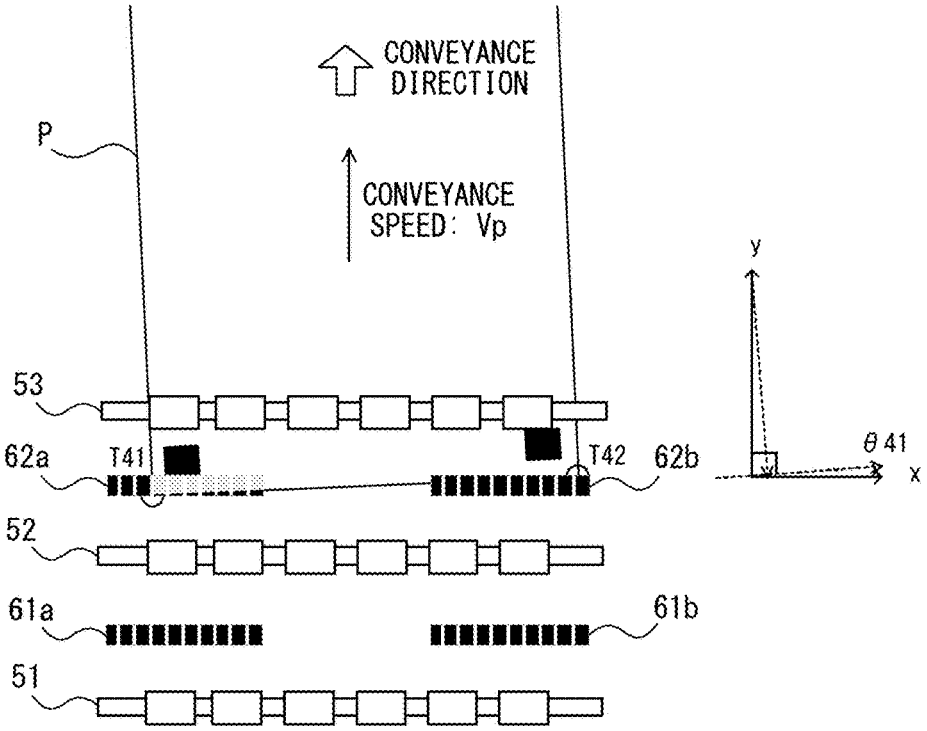

FIG. 13A and FIG. 13B are explanatory views for illustrating a case of detecting an inclination of the trailing edge of the sheet 16. FIG. 13A is an illustration of a posture state given when the trailing edge of the sheet 16 passes through the reading positions of the CISs 61*a* and 61*b*. FIG. 13B is an illustration of a posture state given when the trailing edge of the sheet 16 passes through the reading positions of the CISs 62*a* and 62*b*.

In FIG. 13A, based on timings T31 and T32 at which the trailing edge of the sheet 16 passes through the reading positions of the CISs 61*a* and 61*b*, a trailing-edge angle θ31 of the side of the sheet 16 at the trailing edge of the sheet 16 with respect to the direction orthogonal to the conveyance direction is detected. For example, the trailing-edge angle θ31 is expressed by the following expression.

$$\theta 31=\arcsin((T31-T32)\times Vp/A)\times 180/\pi \text{ deg}$$

In the expression, "(T31−T32)" represents a difference between a timing at which the trailing edge of the sheet 16 has passed through the reading position of the CIS 61*a*, and a timing at which the trailing edge of the sheet 16 has passed through the reading position of the CIS 61*b*, "Vp" represents a conveyance speed given when the trailing edge of the sheet 16 passes through the reading positions of the CISs 61*a* and 61*b*, and "A" represents a length of the side of the sheet 16 at the trailing edge of the sheet 16.

Similarly, based on timings T41 and T42 at which the trailing edge of the sheet 16 passes through the reading positions of the CISs 62*a* and 62*b* as illustrated in FIG. 13B, a trailing-edge angle θ41 of the side of the sheet 16 at the trailing edge of the sheet 16 with respect to the direction orthogonal to the conveyance direction is detected. For example, the trailing-edge angle θ41 is expressed by the following expression.

$$\theta 41=\arcsin((T41-T42)\times Vp/A)\times 180/\pi \text{ deg}$$

In the expression, "(T41−T42)" represents a difference between a timing at which the trailing edge of the sheet 16 has passed through the reading position of the CIS 62*a*, and a timing at which the trailing edge of the sheet 16 has passed through the reading position of the CIS 62*b*.

As described above, from the result of reading the sheet 16 with the image reading unit 201 during conveyance, the leading-edge angles θ11 and θ21 of the sheet 16, the trailing-edge angles θ31 and θ41 of the sheet 16, the inclination angles θ61*a* and θ62*a* of the left end portion, and the inclination angles θ61*b* and θ62*b* of the right end portion are detected.

Figure 14A:
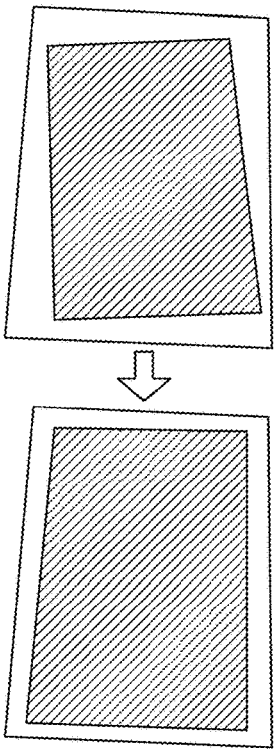
FIG. 14A, FIG. 14B, and FIG. 14C are explanatory views for illustrating the printing position correction.
Figure 14B:
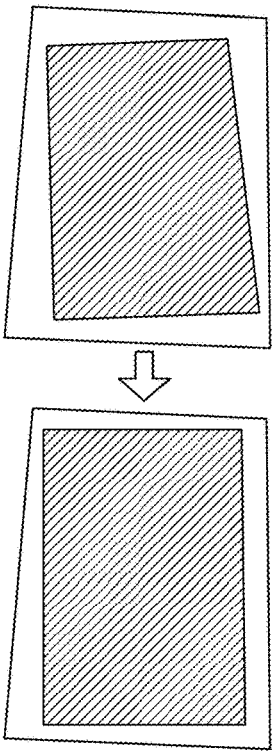
Figure 14C:
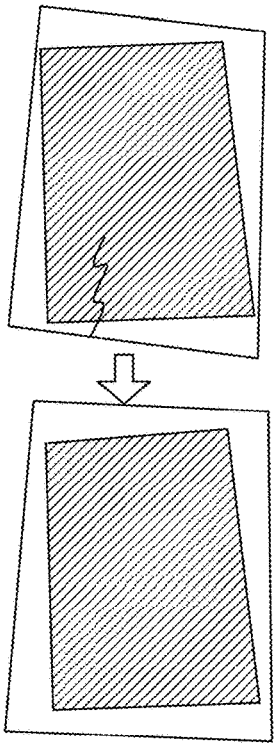

The image forming apparatus 101 performs correction of printing positions with high accuracy based on the angles. Further, based on the result of reading the sheet 16, the posture state and the shape of the sheet 16 at the time of reading are accurately detected. FIG. 14A to FIG. 14C are explanatory views for illustrating image correction based on the posture state and the shape of the sheet 16. FIG. 14A is an illustration of a case of correcting the printing positions in conformity with the shape of the sheet 16. FIG. 14B is an illustration of a case of simultaneously correcting the shape and the printing positions of the image. FIG. 14C is an illustration of detection of a correction error when a wrinkle is formed in the sheet 16.

For example, in the case of correcting the printing positions in conformity with the shape of the sheet 16 (FIG. 14A), the printing positions are detected as follows based on the distances A to J of the measurement images in FIG. 7 obtained from the results of reading the first surface 301. Also with regard to the results of reading the measurement images of the second surface 302, the printing positions are similarly detected through use of the leading-edge angle θ21 and the trailing-edge angle θ41.

$$A\cdot\cos((\theta 11+\theta 31)/2)\cdot\cos((\theta 61a+\theta 61b)/2)$$

$$B\cdot\cos((\theta 11+\theta 31)/2)\cdot\cos((\theta 61a+\theta 61b)/2)$$

$$C\cdot\cos\theta 11$$

$$D\cdot\cos\theta 11$$

$$E\cdot\cos\theta 11\cdot\cos(\theta 61a-\theta 62a)$$

$$F\cdot\cos\theta 31$$

$$G\cdot\cos\theta 11$$

$$H\cdot\cos\theta 11$$

$$I\cdot\cos\theta 11\cdot\cos\theta(\theta 61b-\theta 62b)$$

$$J\cdot\cos\theta 31$$

In the case of simultaneously correcting the shape and the printing positions of the image (FIG. 14B), without use of the inclination angles θ61*b* and θ62*b* of the right end portion and the trailing-edge angles θ31 and θ41, the distances A to J are calculated through use of only the leading-edge angles θ11 and θ21 and the inclination angles θ61*a* and θ62*a* of the left end portion.

In a case where a wrinkle is formed in the sheet 16 (FIG. 14C), it is determined that a correction error indicating inability to correct the printing positions has occurred. It is determined that the correction error has occurred when any one of the following expressions is satisfied.

$$(\theta 11-\theta 31)>\theta\text{limit}$$

$$(\theta 21-\theta 41)>\theta\text{limit}$$

$$(\theta 61a-\theta 62a)-(\theta 61b-\theta 62b)>\theta\text{limit}$$

As described above, the correction error is detected based on whether the difference between angles obtained from the results of reading with the CIS 61*a* and the CIS 61*b* is larger than a predetermined threshold angle (θlimit). In a case where the correction error is detected, skipping of the correction of the printing positions, or processing of prompting a user to check the sheet 16 is performed. There may be given a configuration for detecting the correction error through comparison of each angle with the predetermined threshold angle.

Figure 15:
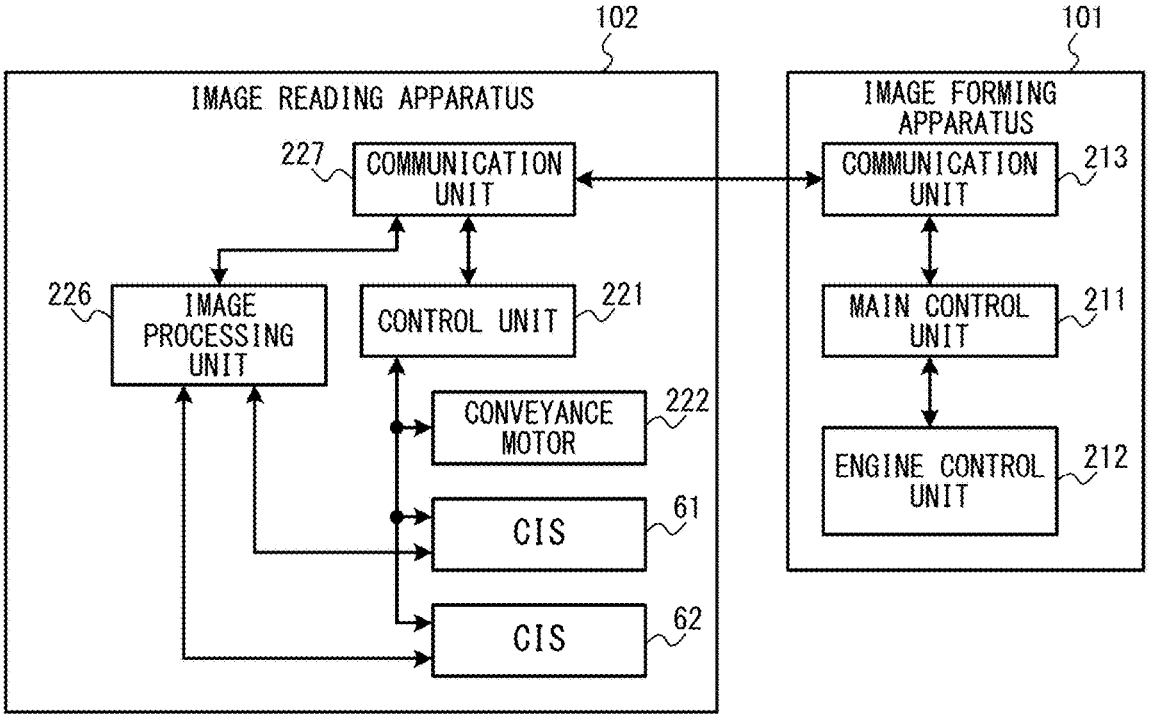
FIG. 15 is an explanatory diagram for illustrating a controller.

FIG. 15 is an explanatory diagram for illustrating a controller configured to perform the correction of the printing positions described above. The image forming apparatus 101 and the image reading apparatus 102 each include a central processing unit (CPU). Each CPU performs an operation control through execution of a computer program. FIG. 15 is an illustration of functional blocks of the image forming apparatus 101 and the image reading apparatus 102. Each function may be achieved through execution of a computer program by the CPU, or at least some of the functions may be configured by hardware.

The image forming apparatus 101 functions as a main control unit 211, an engine control unit 212, and a communication unit 213. The main control unit 211 is configured to control overall operations of the image forming apparatus 101. Particularly in this embodiment, the main control unit 211 is configured to perform correction processing for the printing positions. Under the control by the main control unit 211, the engine control unit 212 controls operations of the configuration for forming an image on a sheet and the configuration for feeding sheets, to thereby perform the image forming process on the sheet 16. The communication unit 213 is a communication interface with respect to the image reading apparatus 102.

The image reading apparatus 102 functions as a control unit 221, an image processing unit 226, and a communication unit 227. The control unit 221 is configured to control operations of the image reading apparatus 102. A conveyance motor 222 and the CISs 61 and 62 are connected to the control unit 221. The control unit 221 performs rotation control of the conveyance roller pairs 31 to 41 through use of the conveyance motor 222 in accordance with an instruction from the main control unit 211. The control unit 221 controls operations of the CISs 61 and 62 to read the sheet 16. The image processing unit 226 is configured to acquire results of reading the sheet 16 from the CISs 61 and 62, and perform predetermined image processing on the results of reading, to thereby generate a read image. The communication unit 227 is a communication interface with respect to the image forming apparatus 101.

The image forming system 100 having such a configuration operates as follows. The main control unit 211 of the image forming apparatus 101 controls the engine control unit 212 to form the measurement images on the sheet 16. The sheet 16 having the measurement images formed thereon is conveyed from the image forming apparatus 101 to the image reading apparatus 102. The main control unit 211 transmits an instruction of image reading to the image reading apparatus 102 through the communication unit 213.

In a case where the instruction of image reading is acquired from the main control unit 211 through the communication unit 227, the control unit 221 of the image reading apparatus 102 starts driving of the conveyance roller pairs 31 to 41 with the conveyance motor 222 to control reading operations of the CISs 61 and 62. When the sheet 16 is conveyed to the reading positions, the CISs 61 and 62 read the sheet 16 and transmit the results of reading to the image processing unit 226. The image processing unit 226 generates the read image based on the results of reading the sheet 16. The image processing unit 226 transmits the read image having been generated to the image forming apparatus 101 through the communication unit 227.

The main control unit 211 of the image forming apparatus 101 acquires deviation amounts of the printing positions based on the read image acquired from the image reading apparatus 102. The method of acquiring the deviation amounts of the printing positions is as described above. The main control unit 211 performs correction of the printing positions based on the deviation amounts of the printing positions, and executes an image forming process based on the image data with the engine control unit 212. In the manner described above, the image forming apparatus 101 is capable of outputting the sheet 16 having the image formed thereon and corrected in printing positions as a product.

Figure 16:
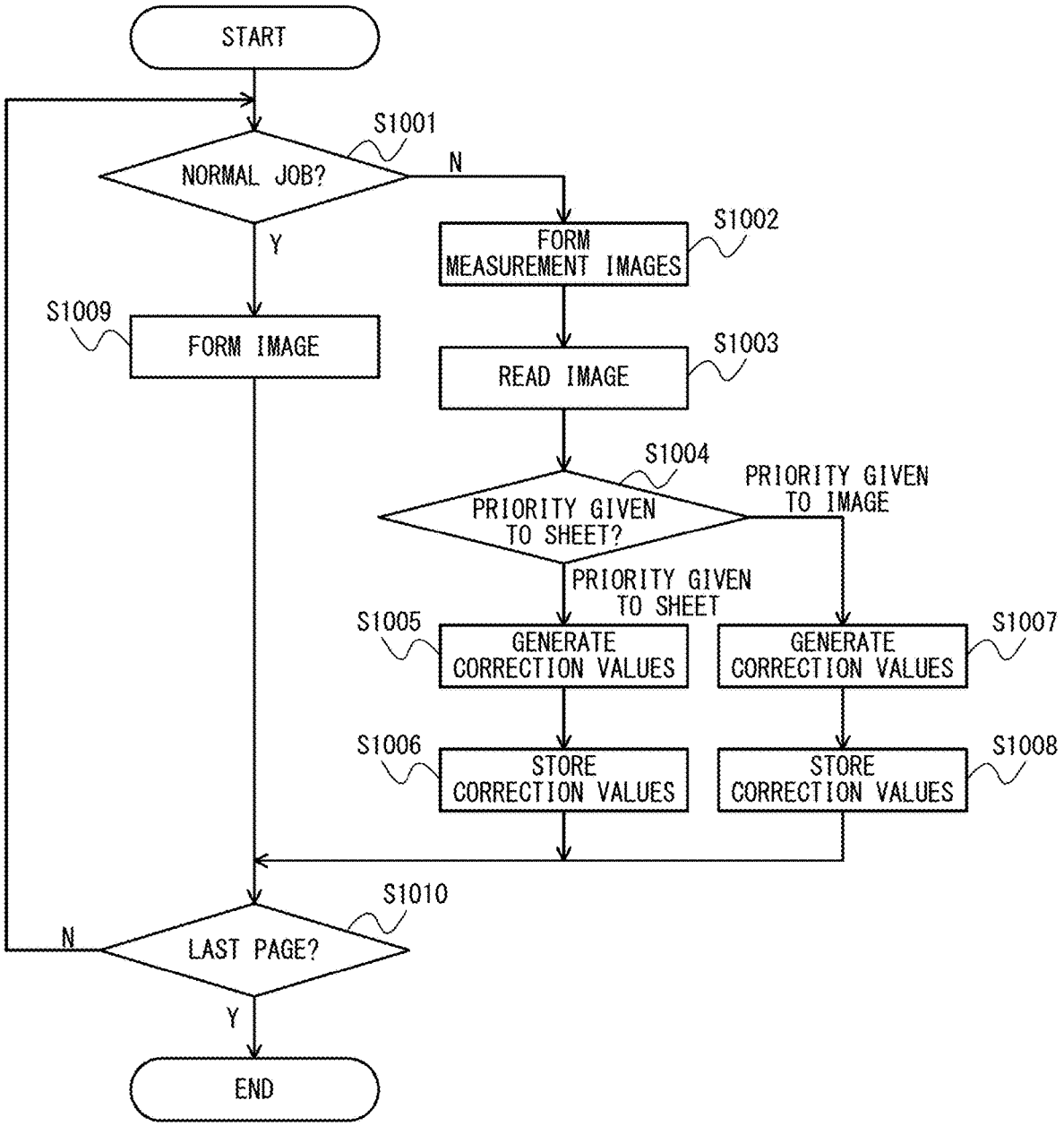
FIG. 16 is a flowchart for illustrating an image forming process.

FIG. 16 is a flowchart for illustrating the image forming process. This process is started as the image forming apparatus 101 acquires a print job for instructing image forming from an external device such as an operation unit or a personal computer (not shown).

The image forming apparatus 101 determines, with the main control unit 211, whether the acquired print job is a normal job for instructing printing based on normal image data, or a correction job for instructing correction of printing positions (Step S1001). In a case where the print job is the correction job (Step S1001: N), the main control unit 211 forms the measurement images on the sheet 16 with the engine control unit 212 (Step S1002). At this time, the correction of the printing positions is not performed. The sheet 16 having the measurement images formed thereon is conveyed from the image forming apparatus 101 to the image reading apparatus 102.

The control unit 221 of the image reading apparatus 102 instructs the CISs 61 and 62 to read the sheet 16. With this, the CISs 61 and 62 read the sheet 16, and transmit results of reading to the image processing unit 226. The image processing unit 226 transmits the read image which has been generated through predetermined image processing on the results of reading to the image forming apparatus 101 through the communication unit 227 (Step S1003).

The main control unit 211 determines whether to correct the printing positions in conformity with the shape of the sheet 16 as illustrated in FIG. 14A (PRIORITY GIVEN TO SHEET) or to simultaneously correct the shape and the printing positions of the image as illustrated in FIG. 14B (PRIORITY GIVEN TO IMAGE) (Step S1004). This determination is performed in accordance with an instruction from a user, which is acquired in advance. When the printing positions are corrected with the priority given to the sheet (Step S1004: PRIORITY GIVEN TO SHEET), as described above with reference to FIG. 14A, the main control unit 211 detects the printing positions, calculates the deviation amounts of the printing positions, and generates the correction values in accordance with the deviation amounts (Step S1005). The main control unit 211 stores the generated correction values in a predetermined memory (Step S1006). When the shape and the printing positions of the image are corrected with the priority given to the image (Step S1004: PRIORITY GIVEN TO IMAGE), as described above with reference to FIG. 14B, the main control unit 211 detects the printing positions, calculates the deviation amounts of the printing positions, and generates the correction values in accordance with the deviation amounts (Step S1007). The main control unit 211 stores the generated correction values in the predetermined memory (Step S1008).

In a case where the print job is the normal job (Step S1001: Y), the main control unit 211 forms an image, which is based on the image data, on the sheet 16 with the engine control unit 212 (Step S1009). At this time, the main control unit 211 corrects the image data based on the correction values stored in the predetermined memory, to thereby correct the printing positions. The main control unit 211 repeatedly performs the processing of Step S1001 and subsequent steps until the processing on the last page instructed by the print job is completed (Step S1010: N). In a case where the processing on the last page instructed by the print job is completed (Step S1010: Y), the main control unit 211 ends the processing.

In this embodiment, a description is made of the example in which determination of the normal job and the correction job is performed for every sheet of the print job. However, the image by the normal job and the measurement images by the correction job may be printed at the same time. In this case, the end portions and the printing positions of the sheet 16 are detected for all of pages of the print job.

As described above, the image forming apparatus 101 according to this embodiment acquires error components of the posture state and the shape of the sheet 16 given at the time of reading the sheet 16 based on the results of reading the measurement images. The image forming apparatus 101 accurately detects the printing positions of the reference images 310 of the measurement images with the error components of the posture state and the shape included in parameters. The image forming apparatus 101 detects the correction values for the printing positions given at the time of image forming based on the detected printing positions of the reference images 310. At the time of normal image forming, the image forming apparatus 101 performs the correction of the printing positions based on the correction values. Therefore, regardless of the posture of the sheet 16 and the shape of the sheet 16 given at the time of reading the measurement images, the positions of the measurement images can be detected with high accuracy, thereby being capable of performing printing position correction with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-043792, filed Mar. 11, 2019 which is hereby incorporated by reference herein in its entirety.

What is claimed is:

1. An image forming apparatus, comprising:

an image forming unit configured to form an image on a sheet;

a conveyance unit configured to convey the sheet in a conveyance path;

a first reading sensor, which is provided on the conveyance path, and is configured to read a first surface of the sheet conveyed by the conveyance unit;

a second reading sensor, which is provided on the conveyance path, and is configured to read a second surface different from the first surface of the sheet conveyed by the conveyance unit, the second reading sensor being provided on an upstream side of the first reading sensor in a conveyance direction of the sheet conveyed by the conveyance unit; and a controller configured to:

control the image forming unit to form a pattern image on the first surface of the sheet;

control the first reading sensor to read the first surface of the sheet on which the pattern image is formed;

control the second reading sensor to read the second surface of the sheet on which the pattern image is formed;

detect an inclination of the sheet on which the pattern image is formed with respect to the conveyance direction based on a first reading result of the first reading sensor and a second reading result of the second reading sensor; and control geometric properties of an image to be formed on the first surface of the sheet by the image forming unit, based on the first reading result and the detected inclination of the sheet.

2. The image forming apparatus according to claim 1, wherein the pattern image includes measurement images, and wherein the controller is configured to detect a posture state and a shape of the sheet at the time of reading from the first reading result and the second reading result, detect printing positions of the measurement images with the detected posture state and the detected shape included in parameters, and to generate correction values for correction of the geometric properties based on the detected printing positions.

3. The image forming apparatus according to claim 2, wherein the controller is configured to detect a leading-edge angle of a side of the sheet at a leading edge of the sheet in the conveyance direction with respect to a direction orthogonal to the conveyance direction from the first reading result and the second reading result, and to detect the posture state based on the leading-edge angle.

4. The image forming apparatus according to claim 2, wherein the controller is configured to detect a trailing-edge angle of a side of the sheet at a trailing edge of the sheet in the conveyance direction with respect to a direction orthogonal to the conveyance direction from the first reading result and the second reading result, and to detect the posture state based on the trailing-edge angle.

5. The image forming apparatus according to claim 2, wherein the controller is configured to detect sides of both end portions of the sheet in a direction orthogonal to the conveyance direction of the sheet from the first reading result and the second reading result, and to detect the posture state based on results of detection of the sides.

6. The image forming apparatus according to claim 5, wherein the controller is configured to detect inclination angles of the sides of the both end portions with respect to the conveyance direction based on the results of detection of the sides of the both end portions, and to detect whether the sheet is in any one of posture states including skew feed, oblique conveyance, and turn based on the inclination angles.

7. The image forming apparatus according to claim 6, wherein the controller is configured to detect the shape of the sheet based on the inclination angles.

8. The image forming apparatus according to claim 2, wherein the controller is configured to, based on the first reading result and the second reading result;

detect a leading-edge angle of a side of the sheet at a leading edge of the sheet in the conveyance direction with respect to a direction orthogonal to the conveyance direction;

detect a trailing-edge angle of a side of the sheet at a trailing edge of the sheet in the conveyance direction with respect to the direction orthogonal to the conveyance direction;

detect inclination angles of sides of both end portions of the sheet in the direction orthogonal to the conveyance direction with respect to the conveyance direction; and detect, in a case where a printing position is to be corrected in conformity with the shape of the sheet, printing positions of the measurement images based on the leading-edge angle, the trailing-edge angle, and the inclination angles, to thereby generate the correction values based on the detected printing positions of the measurement images.

9. The image forming apparatus according to claim 8, wherein, in a case where the shape and the printing position of the image to be printed are simultaneously corrected, the controller detects the printing positions of the measurement images based on the leading-edge angle and the inclination angle of one side, to thereby generate the correction values based on the detected printing positions of the measurement images.

10. The image forming apparatus according to claim 8, wherein the controller is configured to determine that a correction error indicating inability to correct the printing position has occurred based on whether any one of the leading-edge angle, the trailing-edge angle, and the inclination angles is larger than a threshold angle.

11. The image forming apparatus according to claim 1, wherein the controller is configured to control the image forming unit to form another pattern image on the second surface of the sheet, and wherein the controller is configured to control geometric properties of an image to be formed on the second surface of the sheet by the image forming unit, based on the second reading result.

12. The image forming apparatus according to claim 1, wherein the controller detects first angles of both edge portions of the sheet in a direction orthogonal to the conveyance direction of the sheet based on the first reading result, wherein the controller detects second angles of both edge portions of the sheet in the direction orthogonal to the conveyance direction of the sheet based on the second reading result, and wherein the controller detects the inclination based on the first angles and the second angles.

13. The image forming apparatus according to claim 1, wherein the controller controls the geometric properties based on the first reading result and the detected inclination of the sheet to correct a printing position of the image to be formed on the first surface of the sheet.

* * * * *